United States Patent [19]

Maurer

[11] Patent Number: 4,544,108

[45] Date of Patent: Oct. 1, 1985

[54] METHOD FOR WINDING A THREAD ON A BOBBIN AND ELECTRO-HYDRAULIC TRAVERSE MOTION DEVICE FOR CARRYING OUT THE METHOD

[75] Inventor: Martin Maurer, Uttwil, Switzerland

[73] Assignee: Hydrel Ag, Romanshorn, Switzerland

[21] Appl. No.: 656,613

[22] Filed: Oct. 1, 1984

[30] Foreign Application Priority Data

Sep. 30, 1983 [CH] Switzerland ..... 5330/83

[51] Int. Cl.[4] ..... B65H 54/28; B65H 54/32; B65H 54/38

[52] U.S. Cl. ..... 242/43 R; 242/18.1; 242/43.1; 242/158 F

[58] Field of Search ..... 242/43 R, 43.1, 18.1, 242/158 F, 158 R, 26.1, 26.2, 26.3, 26.4

[56] References Cited

U.S. PATENT DOCUMENTS

| | | | |
|---|---|---|---|
| 3,130,930 | 4/1964 | Miller | 242/26.3 |
| 3,286,941 | 11/1966 | Schippers et al. | 242/26.1 |
| 3,367,588 | 2/1968 | Wolf | 242/26.3 |
| 3,375,650 | 4/1968 | Sagehomme . | |
| 3,397,529 | 8/1968 | Wolf | 242/26.3 X |
| 3,406,919 | 10/1968 | Turk et al. | 242/158 F X |
| 3,422,614 | 1/1969 | Durler et al. | 242/26.1 X |
| 3,445,073 | 5/1969 | Schippers et al. | 242/26.3 |
| 3,445,999 | 5/1969 | De Ruig | 242/26.3 X |
| 3,793,821 | 2/1974 | Schafer | 242/26.1 X |
| 4,049,211 | 9/1977 | Spescha . | |

FOREIGN PATENT DOCUMENTS

| | | | |
|---|---|---|---|
| 139061 | 10/1950 | Australia | 242/158 F |
| 584051 | 9/1959 | Canada | 242/158 F |
| 0027173 | 4/1981 | European Pat. Off. . | |
| 1034142 | 4/1953 | France | 242/158 F |
| 413903 | 6/1946 | Italy | 242/158 F |
| 182007 | 7/1936 | Switzerland | 242/158 F |
| 805542 | 12/1958 | United Kingdom . | |
| 1157177 | 7/1969 | United Kingdom . | |
| 1234338 | 6/1981 | United Kingdom . | |
| 212029 | 7/1983 | United Kingdom . | |

*Primary Examiner*—Stanley N. Gilreath
*Attorney, Agent, or Firm*—Blum Kaplan Friedman Silberman & Beran

[57] ABSTRACT

A cylinder (3) has a piston rod (21) with a uniform diameter and is connected to a hydraulic tank (7) by way of a relay valve (4). A first end (27) of a piston rod (21) is directly coupled to a traverse rod (28) carrying a thread guide (29). A second end (31) of piston rod (21) is coupled to an iron core (32) of an inductive position sensor (5), which generates a signal (y) for the actual position of piston rod (21). A shaft (35) for a wound twist-yarn bobbin (37) is equipped with a tachometer generator (38), which generates a signal (v) proportional to the number of revolutions. Output signals (y,v) of position sensor (5) and tachometer generator (38) are applied to an electronic control device (6) which, in accordance with these signals (y,v) and other, digital, adjustable stroke parameters, supplies an analog control signal (s) to relay valve (4). Consequently, all winding functions can be achieved by means of a simple, position-adjusted linear drive and electrical preselection, such as winding angle, edge displacement, stroke shortening and disturbed patterning.

13 Claims, 6 Drawing Figures

METHOD FOR WINDING A THREAD ON A BOBBIN AND ELECTRO-HYDRAULIC TRAVERSE MOTION DEVICE FOR CARRYING OUT THE METHOD

BACKGROUND OF THE INVENTION

This invention relates to a method for winding a spun or twisted thread on a bobbin and an electro-hydraulic traverse motion device, and more particularly to a method and apparatus for winding the thread on a bobbin by rotational movement of a shaft to rotate the bobbin and hydraulically controlling the traverse motion of a thread guide.

Many mechanical devices for reciprocating thread guides on spinning or twisting machines are known. In the devices, the essential functions work off a single drive. These include the traverse stroke, winding angle, edge displacement, stroke shortening and pattern interruption. These functions can be executed only in an inadequate manner and with substantial effort.

For a mechanical drive, the traverse stroke is determined by the geometry of a cylindrical cam. In order to operate with a different traverse stroke, the cylindrical cam must be replaced.

The sine of the winding angle is defined by the relationship of the traverse speed to the winding speed. Thus, the traverse speed is proportional to the feeding speed and can be modified only by modifying the proportionality factor. In mechanical traverse drives, this must occur in stages by means of a change gear, or continuously by means of an intermediate gear with continuous settings.

Edge displacement is necessary in order to wind on cylindrical bobbins at high speed and evenly over the entire length. In mechanical traverse drives, this usually requires an accessory drive that moves the cylindrical cam back and forth by the amount of the edge displacement.

Stroke shortening is necessary for winding on biconical bobbins. This function can be achieved by mechanical means only in a very complicated manner.

A pattern change should occur for avoiding winding resonance in the case of an accident and should also be avoided at both stroke ends. Often a winding disturbance is caused by a time-dependent on and off switching of a magnetic coupling located between the feeding drive and the reciprocating drive. However, a similar control is not provided which guards against accidental occurrence nor the suppression of a disturbed pattern at the stroke ends.

Hydraulic and/or electrical traverse motion devices and changing of gears are known which avoid, in part, the aforementioned disadvantages of mechanical changing gears. However, these function only in an inadequate manner and with great effort.

Accordingly, it is desirable to provide a method for winding a thread on a bobbin and an electro-hydraulic traverse motion device for its execution, whereby a simple hydraulic drive of thread guides can be accurately controlled through electrical selection of all functions required.

SUMMARY OF THE INVENTION

Generally speaking, in accordance with the invention, an electro-hydraulic traverse motion device for winding a yarn or thread on a cylindrical and/or conical bobbin by rotating a shaft operatively coupled to the bobbin is provided. The apparatus includes a piston mounted in a hydraulic cylinder having a piston rod coupled to a reciprocating traverse rod carrying one or more of the thread guides. A shaft is coupled to a tachometer generator, driven by the shaft which generates an electric signal proportional to the speed of the shaft. The piston rod pushes through the hydraulic cylinder on both sides with one end of the piston rod coupled to the reciprocating rod. The opposite end of the piston rod is mounted with an iron core and inserted into an inductive position sensor with the core displaceable within an electrical coil. The position sensor generates an electrical signal corresponding to the position of the piston.

The electrical signal generated by the tachometer generator and the electrical signal generated by the position sensor are fed to an electronic control device for controlling elements for stroke selection. The electronic control device includes a computer unit for generating a control signal which is applied to a relay valve for controlling the pressure input of the hydraulic cylinder. In such manner, the piston proportionately responds to the electrical signal of the tachometer generator and reciprocates back and forth within a preselected stroke range.

The invention permits, by means of a single, position-adjusted, hydraulic linear drive and electrical, in particular digital, preselection or characteristic data, to generate the functions of changing stroke, winding angle, edge displacement, stroke shortening and disturbed patterning in an accurate manner, whereby, as standard controls, only two electrical signals need to be generated, in accordance with the normally constant number of revolutions of the supply and the variable position of the hydraulic piston.

Accordingly, it is an object of the invention to provide an improved method for winding a thread on a bobbin.

It is another object of the invention for providing an improved apparatus for winding a thread on a bobbin.

Yet another object of the invention is to provide an improved electro-hydraulic traverse motion device for winding a thread on a bobbin.

Still other objects and advantages of the invention will in part be obvious and will in part be apparent from the specific- ation.

The invention accordingly comprises the features of construction, combinations of elements, and arrangement of parts and the several steps and the relation of one or more of such steps with respect to each of the others, which will be exemplified in the construction and method hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
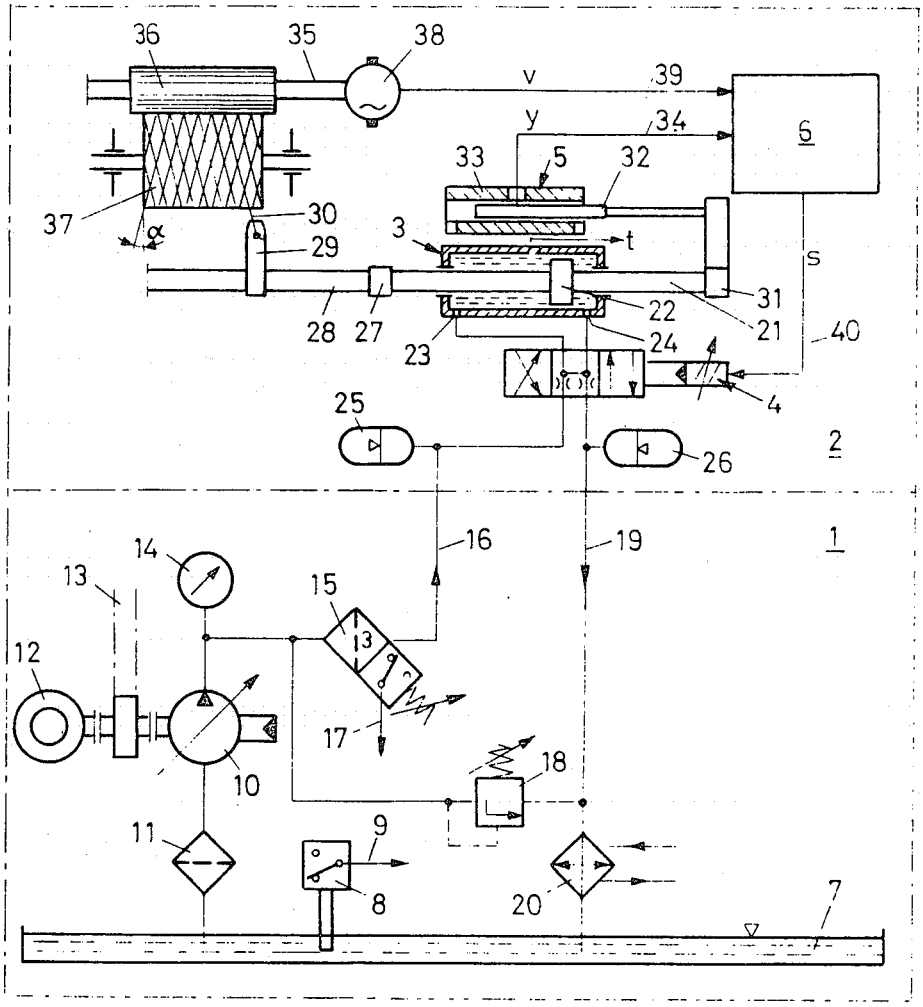
FIG. 1 is a schematic representation of an electro-hydraulic traverse motion device according to the invention.
Figure 2:
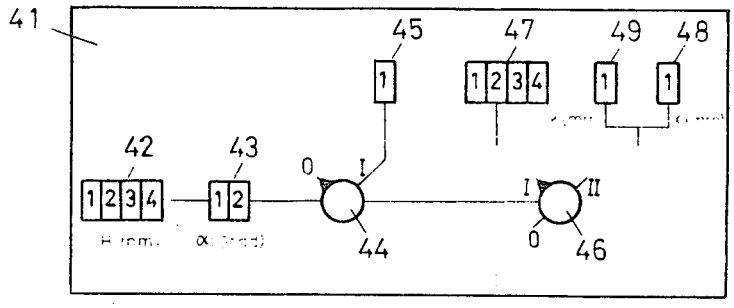
FIG. 2 is a view of an operating panel for the electrical control of the traverse motion device.

The electro-hydraulic traverse motion device shown in FIG. 1 in diagram form is equipped with a hydraulic assembly 1 and a drive control section 2, which contains, in particular, a relay valve 4 connected hydraulically with hydraulic assembly 1 and a cylinder 3, an inductive position sensor 5 coupled to cylinder 3, an electrical or electronic control device 6 and an operation panel shown in FIG. 2.

Hydraulic assembly 1 contains a hydraulic tank 7 for a hydraulic medium, e.g., oil, which is mounted somewhere in the base of a textile machine which has been equipped with the traverse motion device under consideration. Hydraulic tank 7 is equipped with an oil temperature gauge 8 which, in the usual manner, contains a switch in order to change the switch position of a connected signal wire 9 by means of electrical signals, in case of excess temperature of the oil contained in hydraulic tank 7. The suction duct of a pressure-equalizing axial piston pump 10 is connected with hydraulic tank 7 by way of a suction filter 11. Pump 10 may be driven either by an electrical motor 12, as shown, or by way of a toothed belt 13 via a cylindrical shaft (not shown) of the machine.

A manometer 14 for the indication of the operating pressure, is mounted on the pressure duct of pump 10. Pump 10 feeds, via a pressure filter 15, an oil supply duct 16 for relay valve 4. Pressure filter 15, which controls the purity of the pressure oil fed to relay valve 4, is also equipped with a switch, in order to change the switch position of a connected signal line 17 by means of electrical signals, in case the filtrate at pressure filter 15 exceeds a certain filtrate level. An adjustable pressure relief valve 18 is installed for the purpose of selecting the maximum operating pressure between the pressure duct of pump 10 and an oil return duct 19 for the oil in the bypass. The oil flowing back via return duct 19 to hydraulic tank 7, is air-cooled by a cooler 20.

In drive and control section 2, cylinder 3 has a piston rod passing through it with a uniform diameter, which carries a piston 22. Cylinder 3 has therefore two connecting bores 23 and 24, via which the cylinder spaces, separated by piston 22, are connected with corresponding connections to relay valve 4, which is also connected with oil supply duct 16 and oil return duct 19. These ducts 16 and 19 are each equipped with an accumulator 25, or 26, in order to overcome the inertia of the pressure oil. Preferably, relay valve 4 and accumulators 25, 26 are mounted on cylinder 3.

A first end 27 of continuous piston rod 21 is directly coupled to a traverse rod 28, on which, in a known manner, one or more thread guides 29 have been mounted for winding a corresponding thread 30. An opposed end 31 of piston rod 21 is coupled to an iron core 32 of inductive position sensor 5, in such manner that iron core 32 is displaced in the same direction and to the same degree as piston 22, in a surrounding electrical coil 33. Preferably, the housing of piston sensor 5 is also mounted on cylinder 3. Position sensor 5 supplies, to an output line 34 connected with bobbin 33, an analog voltage signal indicating the actual position of piston rod 21 or of piston 22.

A shaft 35, of a known version, equipped with at least one cylinder 36 for turning wound twist-yarn bobbin 37, has been further provided with a tachometer generator 38, which senses electrically the number of rotations of the shaft 35 and, at its output line 39, generates an analog voltage signal v.

For analog electrical control of relay valve 4 for the purpose of controlling the stroke and the traverse speed of piston rod 21 or piston 22, relay valve 4 has been equipped with an input line 40 with which an analog voltage signal s can be supplied to relay valve 4. An output line 34 of inductive position sensor 5, output line 39 of tachometer generator 38, and input line 40 of relay valve 4, are coupled to corresponding inputs or outputs, of electronic control device 6.

Electronic control device 6 includes a digital control section and an analog closed-loop circuit section, not shown in detail here. Control device 6 is designed, by means of corresponding circuit layouts and computing units, to adjust, on the one hand, the traverse speed, i.e., the speed of piston rod 21 or piston 22, depending upon the measured number of revolutions of shaft 35 supplied by the tachometer generator 38 (voltage signal v on line 39) as command variables. Device 6 also controls stroke numbers and stroke variables dependent upon the position of piston 21 measured by position sensor 5 (voltage signal y on line 34). Each is dependent upon control elements, further explained hereafter, for various modes of operation of the traverse motion device; in both cases by releasing an appropriate voltage signal s via input line 40 of relay valve 4.

The control elements mentioned are mounted on a control panel 41 which is separate from electronic control device 6 and connected to it by a plug-in cable. A simplified example of a control panel is shown in FIG. 2. These control elements consist of several monitoring switches or decade monitoring switches. A first monitoring switch 42, which includes four decades, permits adjustment of the traverse stroke H with a resolution of, for example, 0.1 mm. A second decade monitoring switch 43, including two decades, permits the adjustment of the winding angle shown in FIG. 1, for example within a range of 10° to 45° with a resolution of 1°.

Furthermore, a double monitoring switch 44 has been included to achieve a winding change with or without a disturbed pattern, explained hereafter, in accordance with the switch position "O" or "I". When operating with a disturbed pattern (switch position "I"), one can select, by means of an appropriate decade monitoring switch 45, how many traverse strokes between one and nine per disturbed pattern should be executed.

A triple monitoring switch 46 effectuates, in its first switch position "O", a traverse operation without stroke shortening and without edge displacement; which will be further explained hereafter. In a second switch position "I", the traverse operation involves a stroke shortening. By means of a decade monitoring switch 45 with four decades, which cooperates with this latter switch position, it is possible to select after how many double strokes the traverse stroke will be shortened on each side by a given length, for example, 0.1 mm. In the third switch position "II", finally, the traverse operation with an edge displacement will occur. It is possible to adjust a first corresponding decade monitoring switch 48 with one decade with the amount X of the stroke change per individual stroke, in the range of, for example, 0.1 to 0.9 mm, and a second corresponding decade monitoring switch 49 with one decade with the total edge displacement, for example, in the range of 1 to 9 mm.

The monitoring switches and the decade monitoring switches mentioned are connected to corresponding digital inputs (not shown here) of control device 6 (FIG. 1). Control device 6 has, in addition, other digital inputs (not shown here) to which line 9 (FIG. 1) of the oil temperature control 8, as well as line 17 of the pressure filter 15, have been connected. Moreover, it may be equipped with digital inputs for a connection with a closing contact of the main switch of the machine, and a release contact of the control of supply shaft 35.

Control device 6 is also equipped, in an advantageous manner, with several digital outputs (not shown here) to which, according to the mode of operation, signals are supplied to signal lamps via the corresponding lines. Such lamps (not shown here) are mounted on the operating panel 41 in FIG. 2. By means of similar signal lamps it can be shown that the control is switched on, that everything is ready to operate, that the oil temperature is too high, the pressure filter 15 (FIG. 1) is clogged, and that the difference between the target position and the actual position of piston rod 21 or of the piston is greater than a given value, for example 1 mm. Furthermore, control device 6 may be equipped with another digital output for supplying a stop signal when a disturbance occurs, or a go signal when the machine is free of disturbances.

Described hereafter, by reference to FIGS. 3 through 6, are various methods of operation of the traverse device in accordance with the invention. For starting the operations, the traverse variables are given by the adjustment of monitoring switches 44, 46 and decade monitoring switches 42, 43 and 45, 47, 48, 49 (FIG. 2). Subsequently, the main drive of the machine is turned on, whereby the aforementioned signal lamp "Control on" lights up. As a result, the computer unit contained in control device 6 (FIG. 1) will read all the preselected values. When all the values have been read, including the actual position of piston rod 21 or piston 22 on the basis of corresponding voltage signal y on output line 34 of position sensor 5, and when no disturbance is present, the aforementioned signal lamp "Ready for Operations" will light up.

As a result, the cylindrical shaft of the machine will start up which drives pump 10 by way of toothed belt 13 (FIG. 1), or electrical motor 12 will run for driving pump 10, whereby pump 10 builds up pressure for relay valve 4, followed by compensation of this pressure. Next, the yarn winding will start up by means of a rotary movement of cylinder 36 as well as the control of the traverse movement, whereby, as mentioned, tachometer generator 38 generates voltage v as a guide value for the traverse speed and position sensor 5 generates voltage y as the actual position of piston rod 21 or piston 22. Preferably, electrical coil 33 of position sensor 5 is constructed in such manner that the position sensor has a neutral position corresponding to half the stroke. Specifically, a stroke of, for example, 150 mm, will extend over, 75 mm to +75 mm from the central position of position sensor 5. As a result, control device 6 receives the information whether piston 22 is of the right or the left of the stroke center, so that it can always move, at the beginning, away from the center of the stroke.

In a first manner of operation of this traverse motion device, the change in direction is carried out without disturbing the pattern, without stroke shortening and without edge displacement. Before the machine is switched on, the monitoring switches 44 and 46 (FIG. 2) are each placed in the "O" switch positions. By means of the decade monitoring switch 42, the desired total stroke H is set. By means of the decade monitoring switch 42, the desired total stroke H is set. By means of the decade monitoring switch 43, the desired winding angle $\alpha$ (FIG. 1) is set, which is defined by the equation: $\sin \alpha$ = traverse speed/winding speed whereby the winding speed is proportional to the diameter of cylinder 36 and proportional to the number of revolutions of cylinder 36 or shaft 35. Thus, the traverse speed which, as mentioned at the beginning, is proportional to the winding speed, will be adjusted by control device 6, with regard to the chosen winding angle by applying a corresponding control signal s via line 40 to relay valve 4.

Figure 3:
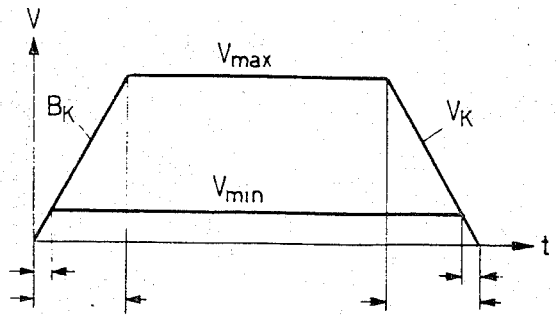
FIG. 3 is a speed/time diagram for a stroke of the traverse motion device.

FIG. 3 shows the speed diagram of a traverse stroke with a constant operations speed V as a function of the time t. From this it is clear that the acceleration and deceleration at the stroke ends are constant, independent from the respectively constant operational or traverse speed, between a minimum operational speed Vmin and a maximum operational speed Vmax, i.e., the speed curve has a constant slope Bk, or Vk. The constant acceleration or deceleration may, for example, be about 50 $m/s^2$.

Figure 4:
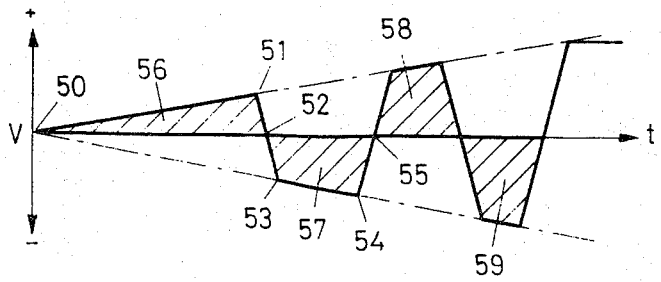
FIG. 4 is a speed/time diagram for the drive of the traverse motion device.

FIG. 4 shows the speed diagram of the traverse motion drive for variable control speeds V as a function of the time t as this occurs during the drive of this traverse motion device. The displacement of rod 28 by piston 22 (FIG. 1) starts at a moment in time 50 (FIG. 4) and accelerates proportionally to an operational value V of tachometer generator 38 (FIG. 1). The drive speed reaches a point in time 51, at which it has to diminish because the drive has driven the piston with a constant braking deceleration, at a following point in time 52. The displacement will hereupon accelerate constantly in the opposite direction and reach, at a point in time 53, again the operational speed of tachometer generator 38, but with a negative value. This continues until a point in time 54, is then constantly braked and, at a point in time 55, reaches the other stroke end. This will go on as long as the operational speed V remains constant and the travel trapezoids 56, 57, 58, 59, etc., in the positive and negative speed ranges, are of the same size.

Figure 5:
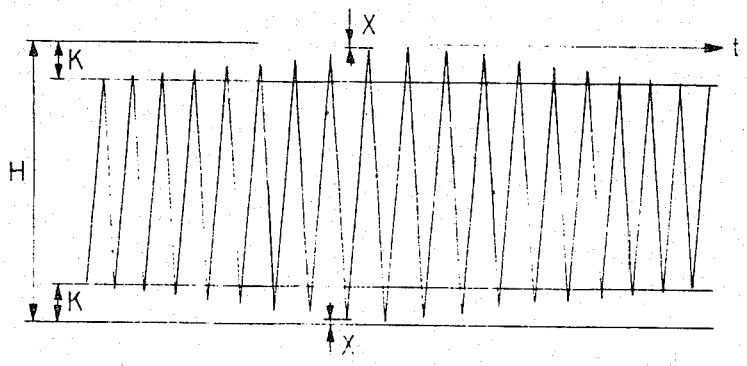
FIG. 5 is a stroke time diagram with edge displacement of the traverse motion device.

FIG. 5 shows a stroke-time diagram for changing the edge displacement. In this instance, the traverse stroke H for each individual stroke will be alternately reduced at each stroke end by an amount X. As soon as the sum of all these amounts X reaches the value of a desired total edge displacement K, the traverse stroke H is increased alternately for each individual stroke at each stroke end by the same amount X, until the total stroke H is reached once more. For achieving a similar edge displacement or stroke modification which can be repeated as often as possible, the triple monitoring switch 46 (FIG. 2) will be placed in the switch position "II" before the machine is started up. At the same time, decade monitoring switch 48 will be set in the amount X. The value of the desired total edge displacement K can be adjusted with decade monitoring switch 49. Counting of the increments X and comparison of the total of the increments X with the value K is performed in the computing section of control device 6 (FIG. 1).

Alternatively, the stroke may not be modified after each movement, but rather after an adjustable number of $n_1$ stroke movements with equal stroke by a given amount. The number $n_1$ can, for example, be preselected from 0 to 15. When the stroke has reached the maximum, in this position, $n_1 \times n_2$ stroke movements will occur with a constant, maximum stroke, whereby the number $n_2$ can, for example, also be preselected from 0 to 15. Accordingly, instead of one decade monitoring switch 48, two decade monitoring switches (not shown) are required for setting the number $n_1$and the number $n_2$.

As an alternative to the above described edge displacement, a similar stroke shortening step can also be achieved for the winding of biconical bobbins. For this purpose, the stroke has to be shortened proportionally to the number of winding positions or to the number of groups with winding positions of the same length. The stroke shortening will be executed through a suitable design of control device 6, symmetrically on both sides with fixed, small, firm steps of, e.g., 0.1 mm. For the execution of this manner of operation of the traverse device under consideration, monitoring switch 46 (FIG. 2) will be placed in the switch position "I". It will then be possible to select, with decade monitoring switch 47, after how many double strokes the traverse stroke has to be shortened on both sides by a small step of, e.g., 0.1 mm.

Figure 6:
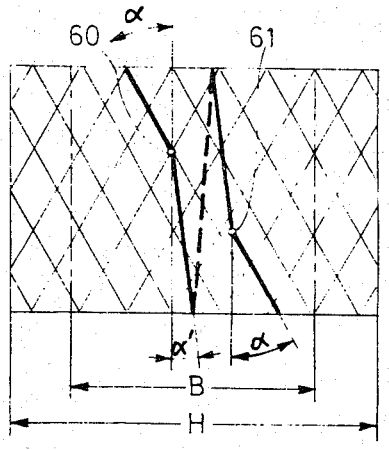
FIG. 6 is a schematic representation of an anti-pattern on a bobbin wound with the traverse motion device.

FIG. 6 shows a schematic view of a disturbed pattern on a wound bobbin 37'. A disturbed pattern is formed to avoid a so-called winding resonance. The winding angle $\alpha$, at a position 60 in a partial range B of a bobbin 37' wound with strike H is reduced to a winding angle $\alpha'$. This is about half the size of winding angle $\alpha$. Traverse rod 28 with thread guide 29 (FIG. 1) is displaced with half the control speed. A range B should amount to about 60% of stroke H of bobbin 37'. The length of the disturbed pattern up to the position 61 depends on the distance and, as a rule, amounts constantly to 10% of selected stroke H. The position of the disturbed pattern in the acceptable range B cannot be cyclic, thus, the beginning of the disturbed pattern at position 60, i.e., the brief reduction of the traverse speed, is therefore determined in control device 6 (FIG. 1) by a random generator. In order to generate a disturbed pattern of this nature on a wound bobbin, monitoring switch 44 (FIG. 2) is placed in the switch position "I". For this purpose, the decade monitoring switch 45 is adjusted according to the frequency, i.e., the number of traverse double strokes per disturbed pat- terning.

Should the machine be brought to a halt due to the switching off of the main drive or a current interruption, the disturbed patterning and the edge displacement will occur, when the machine is restarted, at any permissible position of the partially wound bobbin, but no stroke shortening will take place. The stroke used before the interruption is minimized in control device 6 (FIG. 1) for an extended period of time, e.g., to up to 72 hours.

It will thus be seen that the objects set forth above, among those made apparent from the preceding description, are efficiently attained and, since certain changes may be made in the above construction and process without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A method for winding a yarn or thread on a cylindrical or conical bobbin, comprising:

rotating a shaft operatively coupled to the bobbin;

reciprocating a hydraulically controlled traverse member having at least one thread guide thereon for feeding the yarn to the rotating bobbin;

generating an electrical guide signal in response to and proportional to the speed of the shaft;

generating a position signal depending on the position of a hydraulic piston means coupled to the traverse member for driving the traverse member;

setting monitoring switch means coupled to an electronic control means for controlling piston speed and piston stroke in response to the guide signal and position signal; and applying the guide signal and position signal to the electronic control means for generating a signal applied to the hydraulic means for regulating the piston speed and piston stroke.

2. The method of claim 1, including generating an analog guide signal and an analog position signal and applying the analog signals to the electronic control means for generating an analog control signal.

3. The method of claim 1, including the step of displacing the hydraulic piston means at a constant acceleration or deceleration at the end of each piston stroke.

4. The method of claim 1, including adjusting the piston stroke, for the purpose of an edge displacement, after an adjustable number of $n_1$ stroke movements with equal stroke, until the sum of these adjustments has reached a specific total value of edge displacement in such manner that the stroke movements fall within a stroke range between the maximum stroke and the difference between the maximum stroke and the doubled total value of the edge displacement, and increasing the number of stroke movements with equal strokes for the maximum stroke value by a multiple of $n_1$.

5. The method of claim 1, including the step of shortening each piston stroke by a selectable number of stroke movements on each side and by the same amount, for forming a bobbin having a trapezoid semi-cross-section.

6. The method of claim 1, including changing the speed of the hydraulic piston means, for the purpose of a disturbed pattern within a partial range of the traverse member, which does not include the strike ends.

7. An electro-hydraulic traverse motion device for winding yarn or thread on a cylindrical or conical bobbin, comprising:

a hydraulic reservoir (7);

a hydraulic cylinder (3) coupled to the reservoir and having a piston rod (21) with a first end (27) and a second end (31), each end of the piston rod extending from the ends of the cylinder;

a piston (22) mounted on the piston rod;

relay valve means (4) for regulating hydraulic pressure on each side of the piston within the cylinder;

a reciprocating traverse member (28) coupled to the first end of the piston rod;

at least one thread guide (29) mounted on the traverse member for feeding the yarn or thread to a bobbin;

an iron core (32) on the second end of the piston rod and an inductive position sensor means (5), said iron core displaceable within said sensor means for generating an electrical position signal (y) in response to displacement of said iron core;

a rotatable shaft (35) operatively coupled to a bobbin;

tachometer generator means (38) coupled to the shaft for generating an electrical speed signal (v) proportional to the speed of the shaft; and electronic control means (6) including control, selectable switch and computing means, said electronic control means for generating a control signal (s) to be applied to the relay valve means in response to said speed and position signals thereto; whereby the piston (22) is displaced proportionally in response to the electrical signal (v) of the tachometer generator and reciprocates within a preselected stroke range for moving said traverse member and thread guide.

8. The traverse motion device of claim 7, wherein each of the tachometer generator means and the position sensor means is adapted to generate an analog electrical signal and said selectable switch means is adapted to provide for digital selection of stroke values, and the electronic control means is adapted to generate an analog control signal to be applied to the relay valve.

9. The traverse motion device of claim 8, wherein the switch means includes a decade monitoring switch for the selection of the piston stroke and a decade switch for the selection of the winding angle.

10. The traverse motion device of claim 8, wherein the control means includes a monitoring switch for the adjustment of stroke modification for effectuating an edge displacement and a decade monitoring switch for the selection of one of a given stroke, a repeated stroke-modification value, or for total value of stroke modification.

11. The traverse motion device of claim 8, wherein the control means includes a monitoring switch for the adjustment of a repeated stroke shortening which is equal on both stroke ends and a decade monitoring switch for selecting a given number of stroke movements following which the stroke shortening occurs in order to provide a biconical bobbin.

12. The traverse motion device of claim 8, wherein the control means includes a monitoring switch for the adjustment of a brief and accidental modification in the speed of the piston in a partial range of the stroke and a decade monitoring switch for the preselection of the number of strokes within which the modification takes place, in order to provide a disturbed pattern within a portion of the stroke.

13. The traverse motion device of claim 12, wherein the electronic control means includes random generator means for generating a signal for releasing the brief modification in the speed of the piston.

* * * * *